US008814388B2

(12) United States Patent
Hsu

(10) Patent No.: US 8,814,388 B2
(45) Date of Patent: Aug. 26, 2014

(54) ASSEMBLY LIGHT BAR STRUCTURE

(75) Inventor: Kai-Hsuan Hsu, Yilan (TW)

(73) Assignee: Lextar Electronics Corporation, Hsinchu (TW)

( * ) Notice: Subject to any disclaimer, the term of this patent is extended or adjusted under 35 U.S.C. 154(b) by 207 days.

(21) Appl. No.: 13/560,235

(22) Filed: Jul. 27, 2012

(65) Prior Publication Data

US 2013/0128581 A1 May 23, 2013

(30) Foreign Application Priority Data

Nov. 21, 2011 (TW) ..... 100142607 A

(51) Int. Cl.
*F21V 21/00* (2006.01)
*F21V 29/00* (2006.01)
*F21V 21/002* (2006.01)

(52) U.S. Cl.
CPC ..... *F21V 21/002* (2013.01); *F21V 29/004* (2013.01)
USPC ..... 362/249.02; 362/217.17

(58) Field of Classification Search
CPC ..... F21V 21/002; F21V 29/004
USPC ..... 362/218, 217.17, 653, 249.02
See application file for complete search history.

(56) References Cited

U.S. PATENT DOCUMENTS

| | | | | |
|---|---|---|---|---|
| 7,667,384 | B2 * | 2/2010 | Chen et al. | 362/249.02 |
| 2008/0253121 | A1 * | 10/2008 | Chien | 362/250 |
| 2009/0296394 | A1 * | 12/2009 | Wang | 362/249.02 |

FOREIGN PATENT DOCUMENTS

| | | |
|---|---|---|
| CN | 201568797 | 9/2010 |
| CN | 201851944 U | 6/2011 |
| TW | 200801387 A | 1/2008 |
| TW | M390412 | 10/2010 |
| TW | M416168 | 11/2011 |

OTHER PUBLICATIONS

English language translation of abstract of CN 201568797 (published Sep. 1, 2010).
English language translation of abstract of TW M390412 (published Oct. 11, 2010).
TW Office Action dated Jan. 7, 2014.
English Abstract translation of TW200801387 (Published Jan. 1, 2008).
English Abstract translation of TWM416168 (Published Nov. 11, 2011).
Full English (machine) translation of CN201851944 (Published Jun. 1, 2011).

* cited by examiner

*Primary Examiner* — David V Bruce
(74) *Attorney, Agent, or Firm* — McClure, Qualey & Rodack, LLP

(57) ABSTRACT

An assembly light bar structure includes: a substrate, having at least one recess; a first conductive elastic element and a second conductive elastic element, disposed on the substrate and respectively located at two parallel sides of the recess; and at least one light-emitting element. The light-emitting element is compressed by the first and second conductive elastic elements to be removably fixed in the recess of the substrate. The light-emitting element is electrically connected to the first and second conductive elastic elements.

20 Claims, 5 Drawing Sheets

ASSEMBLY LIGHT BAR STRUCTURE

This application claims the benefit of Taiwan application Serial No. 100142607, filed Nov. 21, 2011, the subject matter of which is incorporated herein by reference.

BACKGROUND

1. Technical Field

The disclosure relates in general to an assembly light bar structure, and more particularly to an assembly light bar structure with replaceable light-emitting elements.

2. Description of the Related Art

An electric lamp is one of the greatest inventions that have brought people with irreplaceable convenience in the daily life. Current common lighting equipments include fluorescent lamps, traditional incandescent light bulbs and the increasingly prevalent energy saving bulbs. Although the above lighting equipments are quite low in cost, they do suffer from drawbacks such as having high power consumption, high thermal energy and short lifespan. Therefore, light-emitting diodes (LED) lighting equipments have become available.

The LED lighting equipment usually includes multiple LEDs. With respect to current techniques, an entire LED lighting equipment may encounter an operation failure and become totally unusable if the LED lighting equipment contains one or more malfunctioning LEDs, meaning that the remaining functional LEDs can only be discarded and put to waste.

Therefore, an assembly light bar structure with replaceable light-emitting elements is provided, so that the lighting bar structure is still utilized once one or more malfunctioning light-emitting elements are replaced.

SUMMARY OF THE DISCLOSURE

The disclosure is directed to an assembly light bar structure with replaceable light-emitting elements. In the assembly light bar structure, light-emitting elements are removably fixed by a conductive complex elastic material to facilitate the replacement of the light-emitting elements.

According to one embodiment the present disclosure, an assembly light bar structure is provided. The assembly light bar structure includes: a substrate, having at least one recess; a first conductive elastic element and a second conductive elastic element, disposed on the substrate and respectively located at two parallel sides of the recess; and at least one light-emitting element. The light-emitting element is compressed by the first and second conductive elastic elements to be removably fixed in the recess of the substrate. The light-emitting element is electrically connected to the first and second conductive elastic elements.

According to another embodiment of the present disclosure, an assembly light bar structure is provided. The assembly light bar structure includes: a substrate, having a plurality of recesses; a first conductive elastic element and a second conductive elastic element, disposed on the substrate and respectively located two parallel sides of the recesses; and a plurality of light-emitting elements. The light-emitting elements are compressed by the first and second conductive elastic elements to be removably fixed in the recesses of the substrate. The light-emitting elements are electrically connected to the first and second conductive elastic elements.

The above and other contents of the disclosure will become better understood with regard to the following detailed description of the preferred but non-limiting embodiments. The following description is made with reference to the accompanying drawings.

Figure 1:
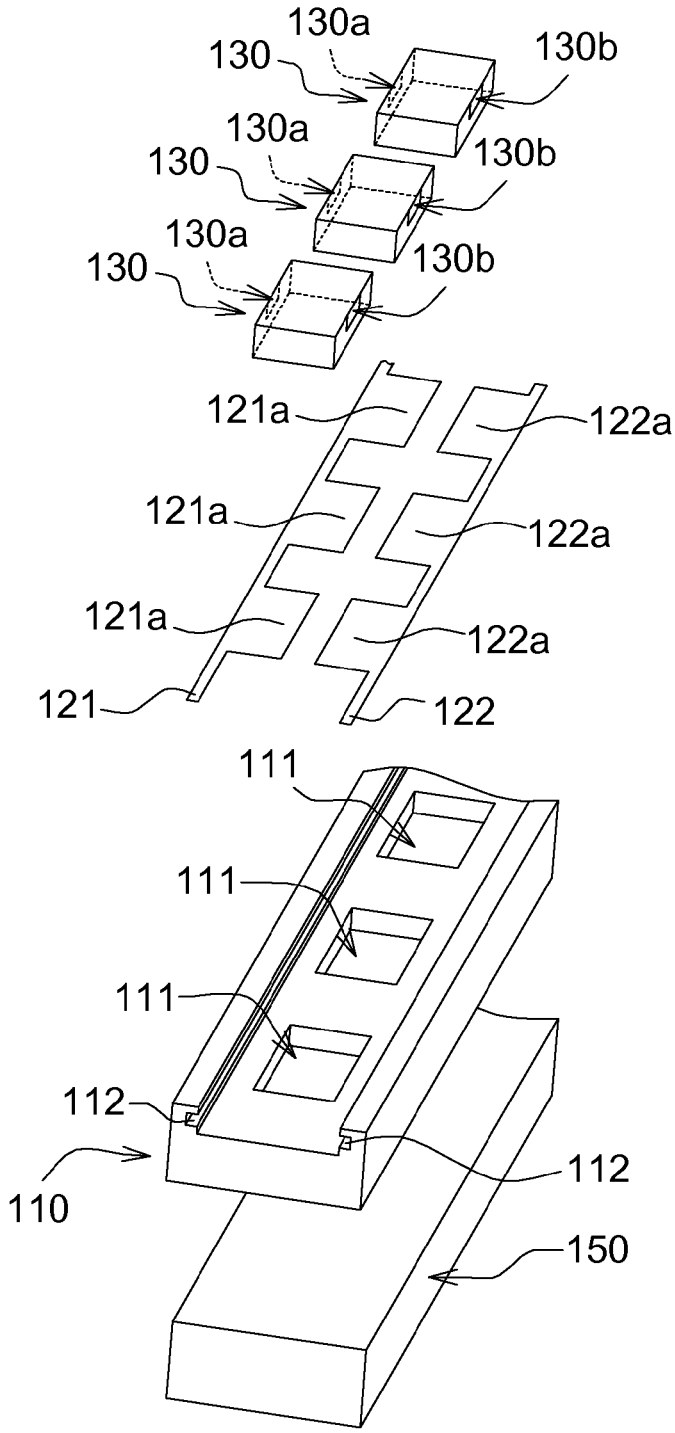
FIG. 1 is an exploded view of an assembly light bar structure according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION OF THE DISCLOSURE

First Embodiment

Figure 2:
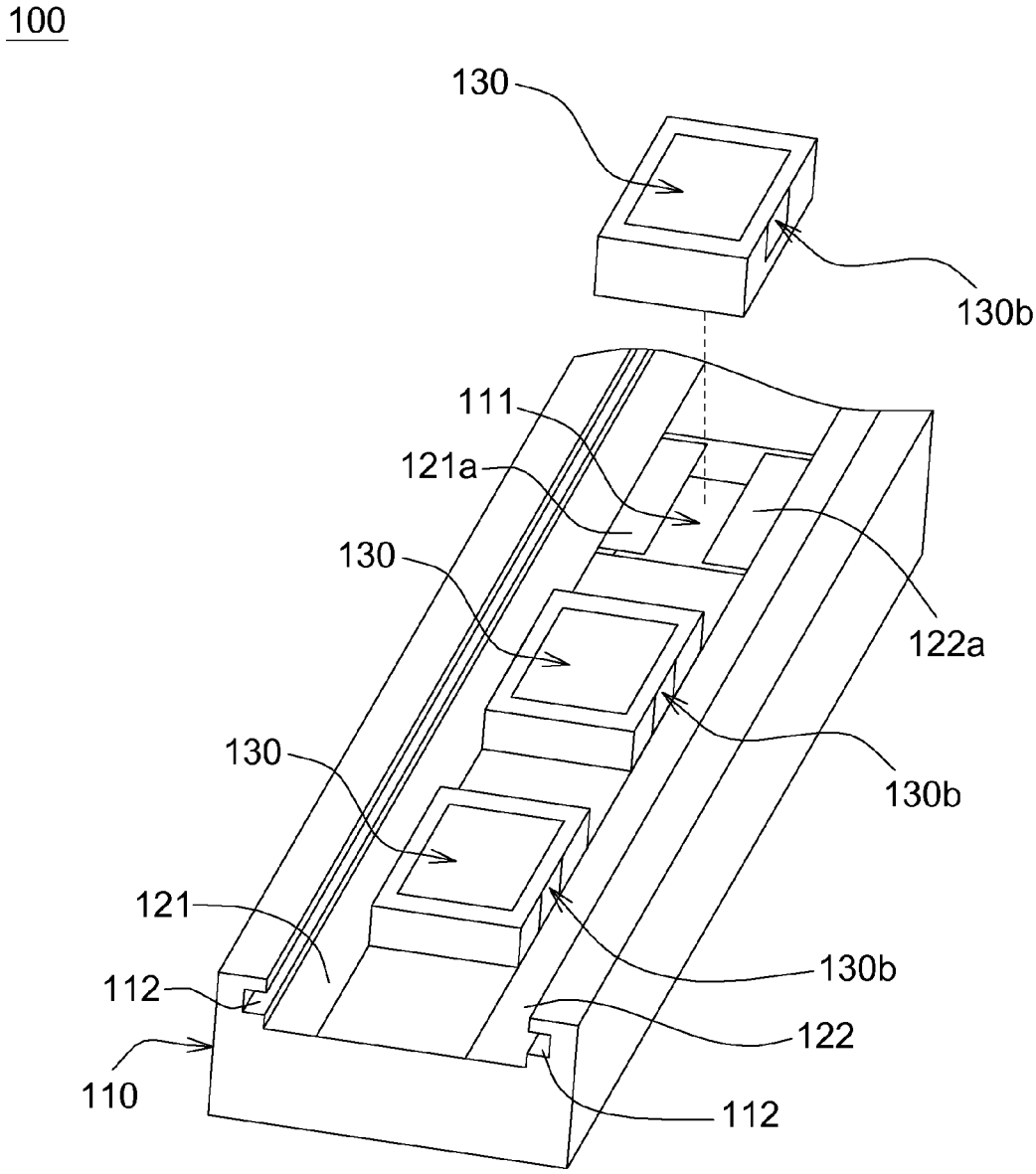
FIG. 2 is an assembly view of the light bar structure according to the first embodiment of the present disclosure.

Referring to FIGS. 1 and 2, FIG. 1 is an exploded view of an assembly light bar structure according to a first embodiment of the present disclosure, and FIG. 2 is an assembly view of the light bar structure according to the first embodiment of the present disclosure.

A light bar structure 100 includes: a substrate 110, having a plurality of recesses 111; a first conductive elastic element 121 and a second conductive elastic element 122, disposed on the substrate 110 and respectively located at two parallel sides of the recesses 111; and a plurality of light-emitting elements 130.

In this embodiment, for example, the substrate 110 is made of a non-conductive material, the first and second conductive elastic elements 121 and 122 are conductive rubber, and the light-emitting elements 130 are LEDs.

The light-emitting elements 130 are compressed by the first and second conductive elastic elements 121 and 122 and are removably fixed in the recesses 130 of the substrate 110. The light-emitting elements 130 are electrically connected to the first and second conductive elastic elements 121 and 122.

The first and second conductive elastic elements 121 and 122 respectively include a plurality of first and second protruding sections 121*a* and 122*a*. The first and second protruding sections 121*a* and 122*a* partially overlap openings of the recesses 111.

Each of the light-emitting elements 130 includes a first conductive unit 130*a* and a second conductive unit 130*b* at two sides thereof. When the light-emitting elements 130 are fixed in the recesses 111, the first and second conductive units 130*a* and 130*b* of the light-emitting elements 130 are respectively electrically connected to the first protruding sections 121*a* of the first conductive elastic elements 121 and the second protruding sections 122*a* of the second conductive elastic elements 122. That is to say, in this embodiment, by employing the elasticity of the first and second conductive elastic elements 121 and 122, the light-emitting elements 130 are fixed in the recesses 11, and through the conductivity of the first and second conductive elastic elements 121 and 122, power is supplied to the light-emitting elements 130 via the first and second conductive units 130*a* and 130*b*, thereby illuminating the light-emitting elements 130 with the provided power.

An area of the recess 111 of the substrate 110 is slightly larger than an area of the light-emitting element 130.

As shown in FIG. 2, one light-emitting element 130 appears as suspended in the air for better illustrating that the first and second protruding sections 121*a* and 122*a* of the first and second conducting elastic elements 121 and 122 partially overlap the openings of the recesses 111. It should be noted that the light-emitting element 130 in FIG. 2, identical to other light-emitting elements 130, is also compressed by the first and second conductive elastic elements 121 and 122 and removably fixed in the recess 110 of the substrate 110, and is electrically connected to the first and second conductive elastic elements 121 and 122.

Figure 3:
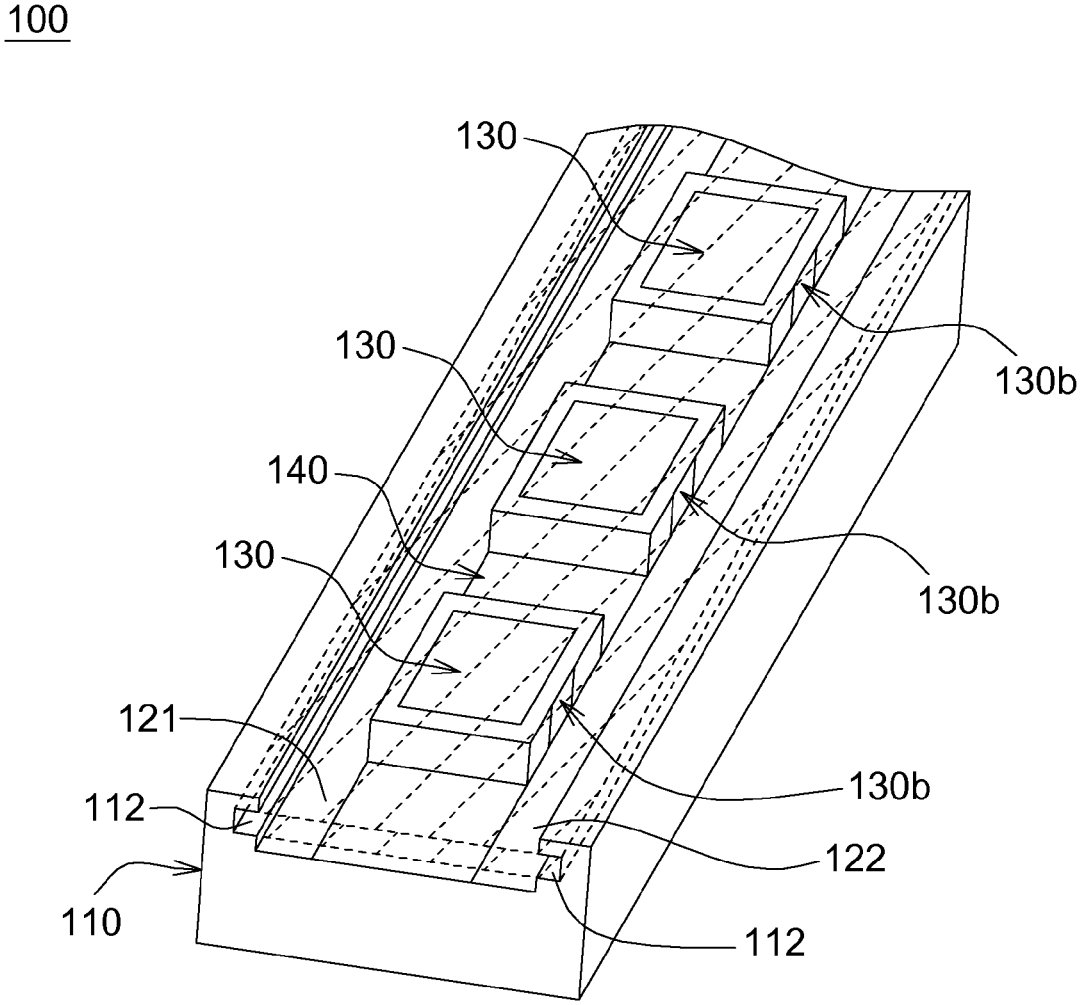
FIG. 3 is an assembly view of another assembly light bar structure further including a transparent cover according to the first embodiment of the present disclosure.

In other possible example of the first embodiment of the present disclosure, the light bar structure 100 may selectively include a transparent cover 140, as shown in FIG. 3. The transparent cover 140 is located above the substrate 110 to cover the light-emitting elements 130, so as to prevent the light-emitting elements 130 from damages caused by external forces. The substrate 100 may further have guiding grooves at two sides thereof in a way that the transparent cover 140 is slidably disposed on the substrate 110 via the guiding grooves 112.

Figure 4A:
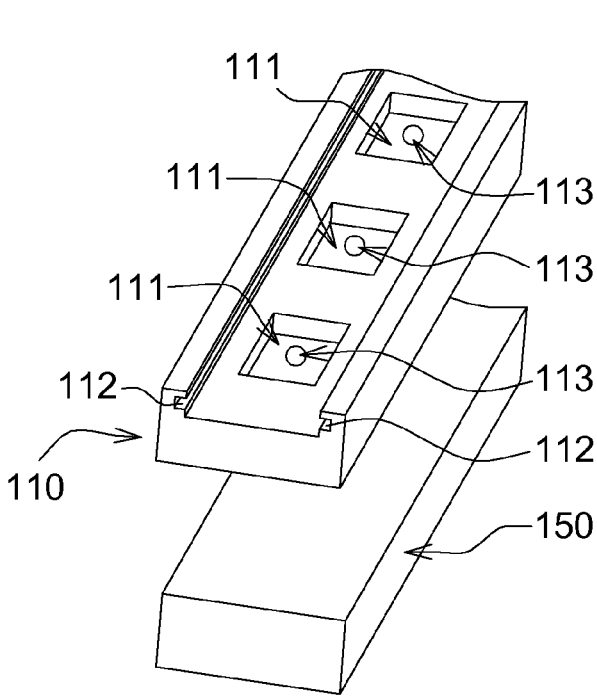
FIGS. 4A and 4B are respectively an exploded view and an assembly view of still another assembly light bar structure, in which recesses further include a heat dissipating module and holes, according to the first embodiment of the present disclosure.
Figure 4B:
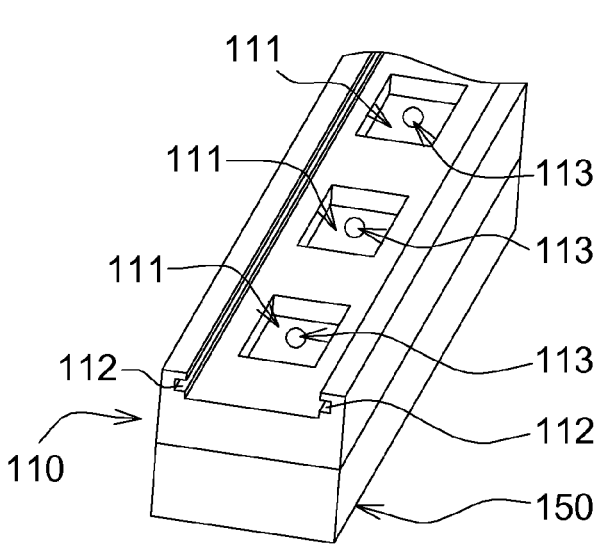

In still other possible example of the first embodiment of the present disclosure, the light bar structure 100 may further optionally include a heat dissipating module 150 below the substrate 110, as shown in FIGS. 4A and 4B. FIGS. 4A and 4B respectively show an exploded view and an assembly view of another assembly light bar structure according to the first embodiment of the present disclosure, with the recesses of the assembly light bar structure including holes.

The recesses 111 of the substrate 110 include holes 113 penetrating through the substrate 110 to reveal the heat dissipating module 150 below the substrate 110, such that the light-emitting elements 130 and the heat dissipating module 150 form thermal contact in between.

It should be noted that, the present disclosure is not limited to each of the recesses 111 having one hole 113 shown in FIGS. 4A and 4B. In an alternative embodiment, instead of providing the hole 113 at each of the recesses 111, some recesses 111 may be provided with the holes 113 while others are not provided with the hole 113. In yet another embodiment, it may be designed that each recess 111 is provided with multiple holes 113 instead of only being provided with one hole 113. Theoretically, heat dissipation efficiency increases as the number of holes gets larger.

Further, in other possible modifications of this embodiment, approaches for fixing the substrate 110 and the heat dissipating module 150 may be, for example, a top end of the heat dissipating module 150 may be provided with a protruding slot (not shown) or a recessed slot (not shown) for engaging a recessed slot (not shown) or a protruding slot (not shown) at the bottom of the substrate 110, thereby fixing the heat dissipating module 150 to the substrate 110.

Second Embodiment

Figure 5:
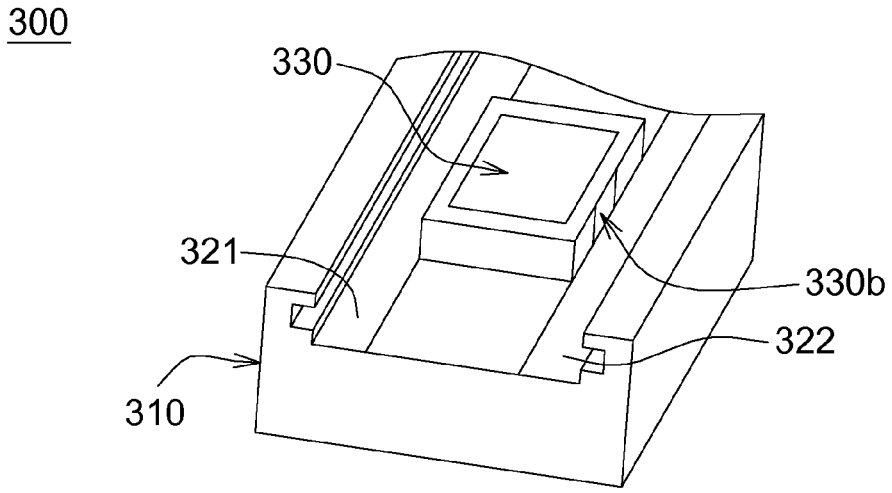
FIG. 5 is an assembly view of a light bar structure according to a second embodiment of the present disclosure.

FIG. 5 shows an assembly view of a light bar structure according to a second embodiment of the present disclosure. In principle, a difference in the second embodiment from the first embodiment is that, the light bar structure according to the second embodiment includes one single recess and one single light-emitting element instead of the plurality of recesses and the plurality of light-emitting elements in the first embodiment.

A light bar structure 300 according to the second embodiment includes: a substrate 310, having a recess (not shown); a first conductive elastic element 321 and a second conductive elastic element 322, disposed on the substrate 310 and respectively located at two parallel sides of the recess; and a light-emitting element 330.

In the second embodiment, details of the substrate 310, the first and second conductive elastic elements 321 and 322, and the light-emitting element 330 are in principle the same or similar to those of the substrate 110, the first and second conductive elastic elements 121 and 122, and the light-emitting elements 130, and shall be omitted herein.

Similarly, the light-emitting element 330 is compressed by the first and second conductive elements 321 and 322 to be removably fixed to the recess of the substrate 310. The light-emitting element 330 is electrically connected to the first and second conductive elastic elements 321 and 322.

The first and second conductive elastic elements 321 and 322 respectively include one single first protruding section (not shown) and one single second protruding section (not shown). The first and second protruding sections partially overlap an opening of the recess.

The light-emitting element 330 includes a first conductive unit (not shown) and a second conductive unit 330*b* at two sides thereof. When the light-emitting element 330 is fixed in the recess 111, the first conductive unit and the second conductive unit 330*b* of the light-emitting element 330 are respectively electrically connected to the first and second protruding sections of the first and second conductive elastic elements 321 and 322. Similarly, in the second embodiment, by employing the elasticity of the first and second conductive elastic elements 321 and 322, the light-emitting element 330 is fixed in the recess, and through the conductivity of the first and second conductive elastic elements 321 and 322, power is supplied to the light-emitting element 330 via the first conductive unit (not shown) and the second conductive unit 330*b*, thereby illuminating the light-emitting element 330 with the provided power.

An area of the recess of the substrate 310 is slightly larger than an area of the light-emitting element 330.

In an alternative example modified from the second embodiment of the present disclosure, the light bar structure 300 may selectively include a transparent cover (not shown). The transparent cover is located above the substrate 310 to cover the light-emitting element 330, so as to prevent the light-emitting element 330 from damages caused by external forces. The substrate 300 may further have guiding grooves (not shown) at two sides thereof in a way that the transparent cover may be slidably disposed on the substrate 310 via the guiding grooves.

In an alternative example modified from the second embodiment, the light bar structure 300 may selective include a heat dissipating module (not shown) below the substrate 310.

The recess of the substrate 310 may be selectively provided with a hole (not shown) penetrating the substrate 310 to reveal the heat dissipating module below the substrate 310, such that thermal contact is formed between the light-emitting element 330 and the heat dissipating module.

Further, details of relations between the recess and the hole in the second embodiment may be the same or similar to those in the first embodiment, and shall be omitted herein.

Further, details of the approach for fixing the substrate 310 and the heat dissipating module in the second embodiment may be the same or similar to those in the first embodiment, and shall be omitted herein.

Therefore, according to the above embodiments of the present disclosure, to replace a bad/malfunctioning light-emitting element of the light bar structure, the bad/malfunctioning light-emitting element is removed from the recess and a replacement light-emitting element is placed into the recess. The replacement procedure is simple and the assembly light bar structure remains usable after replacing the bad/malfunctioning light-emitting element instead of having to discard the entire assembly light bar structure.

In addition, in the manufacturing process of the light bar structure, the light-emitting element is fixed to the light bar structure by the conductive elastic elements without requiring the conventional reflow oven, so that undesirable effects of high temperature on the light-emitting elements are eliminated.

Further, in the embodiments of the present disclosure, the light bar structure has a simple structure, which may be manufactured by an easy process that requires no welding and soldering and may be readily dismantled. Thus, the light bar structure may be manufactured and completed in a small amount of time to shorten the production manufacturing period and to increase product competitiveness.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An assembly light bar structure, comprising:

a substrate, having at least one recess;

a first conductive elastic element and a second conductive elastic element, disposed on the substrate and respectively located at two parallel sides of the recess; and at least one light-emitting element;

wherein, the light-emitting element is compressed by the first and second conductive elastic elements to be removably fixed in the recess, and the light-emitting element is electrically connected to the first and second conductive elastic elements.

2. The light bar structure according to claim 1, wherein the first and second conductive elastic elements respective have a first protruding section and a second protruding section, and the first and second protruding sections partially overlap an opening of the recess.

3. The light bar structure according to claim 2, wherein the light-emitting element respectively comprises a first conductive unit and a second conductive unit at two sides thereof, and the first and second conductive units of the light-emitting element are respectively electrically connected to the first and second protruding sections when the light-emitting element is fixed in the recess.

4. The light bar structure according to claim 1, wherein the substrate is made of a non-conductive material.

5. The light bar structure according to claim 1, wherein an area of the recess is slightly larger than an area of the light-emitting element.

6. The light bar structure according to claim 1, further comprising a transparent cover above the substrate to cover the light-emitting element.

7. The light bar structure according to claim 6, wherein the substrate further comprises a guiding groove for slidably disposing the transparent cover on the substrate.

8. The light bar structure according to claim 1, further comprising a heat dissipating module below the substrate.

9. The light bar structure according to claim 8, wherein the recess of the substrate further has a hole penetrating through the substrate to reveal the heat dissipating module below the substrate, such that thermal contact is formed between the light-emitting element and the heat dissipating module.

10. The light bar structure according to claim 1, wherein the light-emitting element is a light-emitting diode (LED).

11. An assembly light bar structure, comprising:

a substrate, having a plurality of recesses;

a first conductive elastic element and a second conductive elastic element, disposed on the substrate and respectively located at two parallel sides of the recesses; and a plurality of light-emitting elements;

wherein, the light-emitting elements are compressed by the first and second conductive elastic elements to be removably fixed in the recesses, and the light-emitting elements are electrically connected to the first and second conductive elastic elements.

12. The light bar structure according to claim 11, wherein the first and second conductive elastic elements respective have a plurality of first protruding sections and a plurality of second protruding sections, and the first and second protruding sections partially overlap openings of the recesses.

13. The light bar structure according to claim 12, wherein the light-emitting elements respectively comprise a plurality of first conductive units and a plurality of second conductive units at two sides thereof, and the first and second conductive units of the light-emitting elements are respectively electrically connected to the first and second protruding sections when the light-emitting elements are fixed in the recesses.

14. The light bar structure according to claim 11, wherein the substrate is made of a non-conductive material.

15. The light bar structure according to claim 11, wherein an area of the recesses is slightly larger than an area of the light-emitting elements.

16. The light bar structure according to claim 11, further comprising a transparent cover above the substrate to cover the light-emitting elements.

17. The light bar structure according to claim 16, wherein the substrate further comprises a guiding groove for slidably disposing the transparent cover on the substrate.

18. The light bar structure according to claim 11, further comprising a heat dissipating module below the substrate.

19. The light bar structure according to claim 18, wherein the recesses of the substrate further have holes penetrating through the substrate to reveal the heat dissipating module below the substrate, such that thermal contact is formed between the light-emitting elements and the heat dissipating module.

20. The light bar structure according to claim 11, wherein the each of the light-emitting element is an LED.

* * * * *